United States Patent [19]

Weinstein

[11] Patent Number: 4,763,130

[45] Date of Patent: Aug. 9, 1988

[54] PROBE-FED SLOT ANTENNA WITH COUPLING RING

[75] Inventor: Michael E. Weinstein, Huntington Station, N.Y.

[73] Assignee: General Instrument Corporation, New York, N.Y.

[21] Appl. No.: 48,955

[22] Filed: May 11, 1987

[51] Int. Cl.[4] ..... H01Q 13/12

[52] U.S. Cl. ..... 343/770; 343/768

[58] Field of Search ..... 343/767, 768, 770, 771, 343/884

[56] References Cited

U.S. PATENT DOCUMENTS 2,971,193 2/1961 Siukola ..... 343/770
4,197,549 4/1980 Collins ..... 343/771
4,297,707 10/1981 Brunner et al. ..... 343/770
4,631,544 12/1986 Ploussios ..... 343/771

*Primary Examiner*—William L. Sikes
*Assistant Examiner*—Doris J. Johnson
*Attorney, Agent, or Firm*—Barry R. Lipsitz

[57] ABSTRACT

A probe-fed slot antenna is provided having an inner conductor, a cylindrical outer conductor coaxial with the inner conductor, and a plurality of slots in the outer conductor. A plurality of probes extend from the cylindrical outer conductor into the interior, each probe adjacent to one of the slots. A coupling ring is mounted coaxially between the outer and inner conductors to allow efficient transfer of RF energy to and from the slots.

23 Claims, 1 Drawing Sheet

FIG. 1
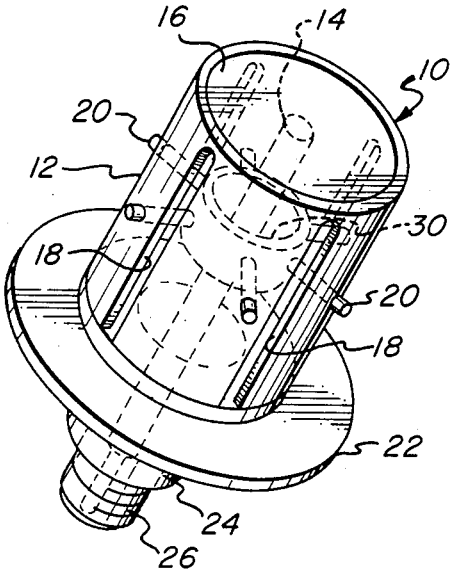
FIG. 2
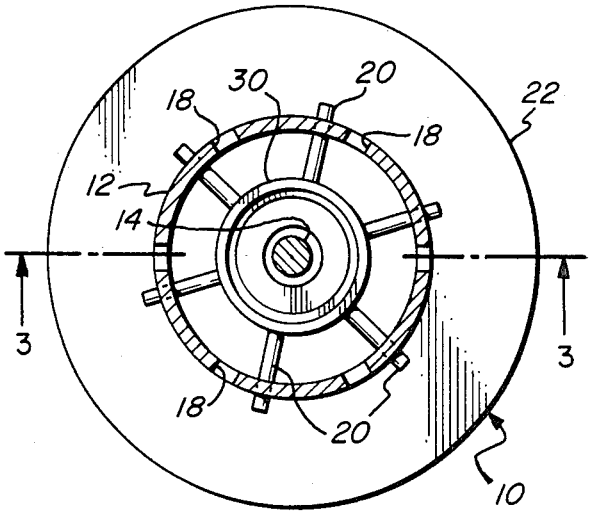
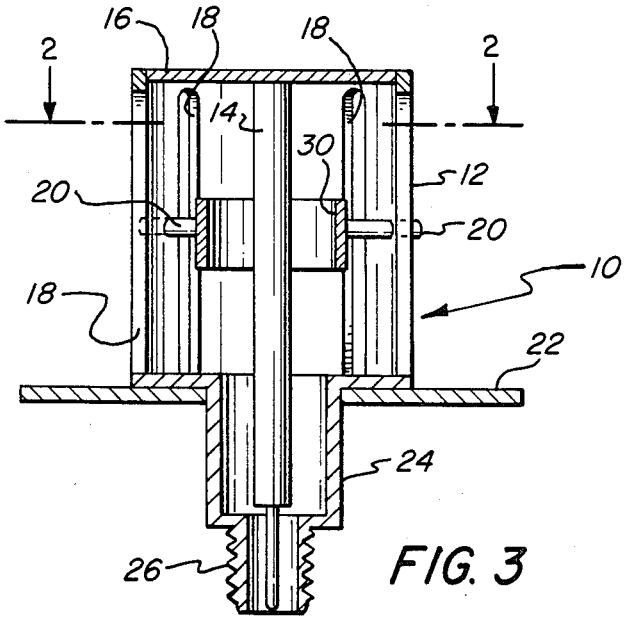
FIG. 3

PROBE-FED SLOT ANTENNA WITH COUPLING RING

BACKGROUND OF THE INVENTION

The present invention relates to a new and improved antenna and more particularly, to an omnidirectional, horizontally polarized probe-fed slot antenna having a conductive coupling ring for efficient coupling of RF energy within the antenna.

Slot antennas are constructed by cutting one or more slots in the wall of a radio frequency ("RF") transmission line to provide an efficient transfer of RF energy between each slot and the transmission line, thereby providing a good return loss for the antenna. Such antennas are well known in the art, and are discussed in Silver, S., *Microwave Antenna Theory and Design,* Boston Technical Publications, pages 305–309 and pages 325–328, and Johnson, Robert C. and Jasik, Henry, *Antenna Engineering Handbook,* 2nd Edition, McGraw Hill, Chapter 9.

Normally, efficient transfer of RF energy in a slot antenna is accomplished when the placement of the slot interrupts RF currents on the wall of the transmission line. When certain antenna characteristics are desired that constrain a slot to a position where no interruption occurs, transfer of RF energy may be accomplished by the use of a conductive probe adjacent to the slot and penetrating into the transmission line. Such a design is useful, for example, in an antenna where an omnidirectional, horizontally polarized radiation pattern is desired. When such an antenna is used in the transmitting mode, the conductive probe "feeds" RF energy from the transmission line to the slot which then radiates the energy into the external environment. Thus, such devices are often referred to as probe-fed slot antennas.

It has been found that even with conductive probes adjacent to the slots of a slot antenna, inefficient coupling of RF energy can result between the transmission line and the slots resulting in a less than optimal return loss, e.g., a return loss no greater than about 3 dB for any probe depth. The literature describes probe-fed slot antenna designs employing multiple (cascaded) sets of slots in order to overcome the poor coupling which can otherwise result. Efficient coupling between the transmission line and the slots exists in such designs because each set of slots only has to couple a portion of the total coupled energy.

There is often a need for antennas, such as beacon antennas or antennas used with active decoys which, due to size and antenna pattern constraints, cannot be provided with additional sets of cascaded slots to improve the RF energy coupling. It would therefore be advantageous to provide a probe-fed slot antenna having improved coupling of RF energy between the transmission line and slots without resorting to multiple sets of slots. Such an antenna should provide an improved return loss, for example on the order of 15 dB or greater at the antenna's operating frequency. The present invention provides a probe-fed slot antenna meeting these requirements.

SUMMARY OF THE INVENTION

In accordance with the present invention, a coupling ring is provided in a probe-fed slot antenna. The coupling ring effects efficient coupling of RF energy between the transmission line and slots.

The antenna comprises an inner conductor, a cylindrical outer conductor which is spaced about and typically coaxial with the inner conductor, and a plurality of slots in the outer conductor. A plurality of probes extends from the cylindrical outer conductor toward a coupling ring that is mounted coaxially between the outer and inner conductors.

In the preferred embodiment, the probes are in electrical contact with the coupling ring and serve as the mounting means which secures the coupling ring between the outer and inner conductors. A shorting plate mounted at one end of the outer conductor electrically connects the outer conductor to the inner conductor. A ground plane can be mounted at the other end of the outer conductor in order to shape the antenna radiation pattern.

The inner conductor can be a conductive rod, for example of aluminum. Similarly, the probes can comprise conductive rods which, when the antenna is designed to provide an omnidirectional, horizontally polarized radiation pattern, are mounted perpendicular to the axis of the inner and outer conductors. The probes can be adjustable longitudinally along their axis to accommodate coupling rings of various sizes and thereby provide fine tuning.

The length of the slots is preferably about one-half the wavelength of radiation to be received or transmitted by the antenna. In a preferred embodiment, the slots are equally spaced around the cylindrical outer conductor and run longitudinally in the cylindrical outer conductor.

The diameter and length of the coupling ring are selected to maximize the return loss at the operating frequency of the antenna. The height of the coupling ring is preferably between about one-quarter to one-half the height of the cylindrical outer conductor. The diameter of the coupling ring is preferably between about three-eighths to three-quarters of the diameter of the outer conductor. In a preferred embodiment, the coupling ring is generally centered between the ends of the cylindrical outer conductor.

BRIEF DESCRIPTION OF THE DRAWINGS

FIG. 1 is a perspective view of a probe-fed slot antenna in accordance with the present invention;

FIG. 2 is a top cross-sectional view of the antenna of FIG. 1, taken along the lines 2—2 shown in FIG. 3;

FIG. 3 is a cross-sectional view of the antenna of FIG. 1, taken along the lines 3—3 shown in FIG. 2.

DETAILED DESCRIPTION OF THE INVENTION

The present invention provides an improved probefed slot antenna having a coupling ring in electrical contact with the inner ends of the probes in order to achieve an efficient coupling of RF energy between the transmission line and the slots, resulting in an improved antenna return loss.

The antenna 10 of the present invention is shown in the figures. A conductive cylindrical outer conductor 12 is fabricated, for example, of aluminum or other metal as is typical in the antenna art. Cylindrical outer conductor 12 contains a plurality of nominally half-wave slots 18 equally spaced around the circumference thereof. A conductive probe 20 is mounted adjacent to each slot 18 and extends through the cylindrical outer conductor 12 from the interior to the exterior thereof. Probes 20 can be adjustable to slide along their axes into and out from cylindrical conductor 12. Probes 20 are typically conductive rods fabricated from the same material which is used for outer conductor 12. It is noted that in accordance with the present invention, probes 20 do not have to actually extend through the wall of outer conductor 12 to the exterior thereof; they need only make contact with the interior wall of the outer conductor to provide proper operation.

An inner conductor 14 is arranged coaxially with outer conductor 12. The inner conductor is typically fabricated of the same conductive material as the outer conductor 12 and probes 20. A shorting plate 16 electrically connects inner conductor 14 to outer conductor 12 at one end of the outer conductor. A ground plane 22 can be connected at the other end of outer conductor 12 to provide beam shaping of radiation transmitted from the antenna. Without ground plane 22, radiation will emanate perpendicularly from the antenna axis. Ground plane 22 comprises a disk which is sized according to the angle of radiation desired in accordance with well-known techniques. In the embodiment shown in the drawings, energy is radiated from the antenna at an angle of approximately 60°–70° from the antenna axis. Thus, the antenna produces a horizontally polarized radiation pattern which substantially matches that of a quarter-wave vertically polarized monopole antenna above a finite ground plane.

A transforming section 24 is provided to step down the diameter of the coaxial transmission line (i.e., inner conductor 14 and outer conductor 12) to a smaller size which is compatible with a conventional type N RF connector 26. Those skilled in the art will appreciate that other types of connectors can be coupled to the antenna. Alternately, the present invention can be applied to antennas constructed on waveguide transmission lines.

In accordance with the invention, a coupling ring 30 is mounted coaxially between outer conductor 12 and inner conductor 14. Coupling ring 30 is fabricated from a conductive material, preferably the same material used for the inner and outer conductors and the probes. The coupling ring provides efficient coupling of RF energy between the transmission line (i.e., inner and outer conductors 14, 12) and the slots 18. The diameter and length of the coupling ring is established empirically, to achieve a desirable return loss.

An antenna was constructed in accordance with the present invention to provide omnidirectional, horizontally polarized operation at 3.1 gigahertz (GHz). It consisted of one set of six, nominally half-wave slots equally spaced around the outer conductor of a coaxial transmission line. Outer conductor 12 was a two inch diameter aluminum tube approximately two and one-half inches long. A ground plane 22 having a five inch diameter was conductively attached around the circumference of outer conductor 12 as shown in the figures. Inner conductor 14 was fabricated from a one-quarter inch aluminum rod. The width of the six slots was approximately three-sixteenths of an inch each, and the slot length was two and one-quarter inches. Six probes 20 were used, each having a length of approximately three-eighths inch. The inner ends of each probe electrically contacted and supported a coupling ring 30. The outer ends of each probe were flush with the outside wall of outer conductor 12. The diameter of coupling ring 30 was approximately one and one-quarter inches and the coupling ring had a height of approximately 0.85 inches.

The return loss of the probe-fed slot antenna with the coupling ring described above was measured at greater than 15 dB at the operating frequency of 3.1 GHz and greater than 10 dB for all frequencies between 2.95 GHz and 3.25 GHz. When the coupling ring was removed, the return loss dropped to no greater than 3 dB for any probe depth.

It will now be appreciated that the present invention enables a probe-fed slot antenna to achieve an improved return loss by enabling efficient coupling of RF energy between the transmission line and slots. Such efficient coupling is not achieved without the use of the coupling ring.

Although the present invention has been described in connection with a preferred embodiment thereof, those skilled in the art will recognize that various modifications and adaptations may be made thereto without departing from the spirit and scope of the invention as defined by the following claims.

I claim:

1. A probe-fed slot antenna comprising:

an inner conductor;

a cylindrical outer conductor spaced about said inner conductor, said inner and outer conductors being associated with each other to form a co-axial transmission line adapted to guide a wave;

a plurality of slots in said outer conductor;

a coupling ring supported between said outer and inner conductors and adapted to couple energy of the wave between said inner and outer conductors; and a plurality of probes extending from said cylindrical outer conductor toward said coupling ring.

2. The probe-fed slot antenna of claim 1 wherein said probes are in electrical contact with said coupling ring.

3. The probe-fed slot antenna of claim 1 wherein at least one of said probes is attached to said coupling ring to support the coupling ring between said outer and inner conductors.

4. The probe-fed slot antenna of claim 1 wherein each probe that extends toward said coupling ring is attached to said coupling ring to support the coupling ring between said outer and inner conductors.

5. The probe-fed slot antenna of claim 4 further comprising a ground plane mounted at one end of said outer conductor.

6. The probe-fed slot antenna of claim 5 wherein said ground plane is a disk.

7. The probe-fed slot antenna of claim 1 further comprising a ground plane mounted at one end of said outer conductor.

8. The probe-fed slot antenna of claim 1 further comprising a shorting plate mounted at one end of said outer conductor to electrically connect said outer conductor to said inner conductor.

9. The probe-fed slot antenna of claim 1 wherein said inner conductor is a conductive rod.

10. The probe-fed slot antenna of claim 9 wherein said probes are conductive rods.

11. The probe-fed slot antenna of claim 1 wherein said probes are perpendicular to the axis of said inner and outer conductors.

12. The probe-fed slot antenna of claim 1 wherein said probes are conductive rods that are slidably received within bores in said outer conductor to vary the protrusion of said probes inwardly of the cylindrical outer conductor.

13. The probe-fed slot antenna of claim 12 wherein said probes are perpendicular to the axis of said inner and outer conductors.

14. The probe-fed slot antenna of claim 1 wherein the length of said slots is about one-half the wavelength of radiation to be received or transmitted by the antenna.

15. The probe-fed slot antenna of claim 14 wherein said slots are equally spaced around said cylindrical outer conductor.

16. The probe-fed slot antenna of claim 15 wherein said slots run longitudinally in said cylindrical outer conductor.

17. The probe-fed slot antenna of claim 1 wherein the diameter of said coupling ring is approximately 1.25 inches and the length of said coupling ring is approximately 0.85 inches to optimize the return loss at an operating frequency of approximately 3.1 GHz .

18. The probe-fed slot antenna of claim 1 wherein the outer ends of said probes are flush with the outer surface of said cylindrical outer conductor.

19. The probe-fed slot antenna of claim 1 wherein the center height of said coupling ring is between about one-quarter to one-half the height of the cylindrical outer conductor.

20. The probe-fed slot antenna of claim 19 wherein the coupling ring is generally centered between the ends of said cylindrical outer conductor.

21. The probe-fed slot antenna of claim 1 wherein the diameter of said coupling ring is between about $\frac{3}{8}$ to $\frac{3}{4}$ the diameter of said outer conductor.

22. The probe-fed slot antenna of claim 1 wherein the coupling ring is generally coaxial with said inner and outer conductors.

23. A probe-fed slot antenna comprising:

a section of co-axial transmission line adapted to guide a wave therein, said transmission line including an inner conductor, a cylindrical outer conductor spaced about said inner conductor, and a pluraltiy of slots in said outer conductor;

a coupling ring supported between said outer and inner conductors and adapted to couple energy of the wave between said inner and outer conductors, said inner conductor extending through said coupling ring, and said coupling ring having an axial length substantially less than an axial length of said inner and outer conductors in said section to partially expose said inner and outer conductors to each other in said section; and a plurality of probes extending from said cylindrical outer conductor toward said coupling ring.

* * * * *